United States Patent [19]

Bengsch et al.

[11] 4,247,842

[45] Jan. 27, 1981

[54] CUT-IN RESISTANCE FOR MOTOR VEHICLE HEATING FANS

[75] Inventors: Helmut Bengsch, Pulheim; Alfons Link, Erftstadt, both of Fed. Rep. of Germany

[73] Assignee: Ford Motor Company, Dearborn, Mich.

[21] Appl. No.: 72,874

[22] Filed: Sep. 6, 1979

[30] Foreign Application Priority Data

Oct. 9, 1978 [DE] Fed. Rep. of Germany ..... 2843967

[51] Int. Cl.[3] ..... H01C 3/20; H01C 7/22

[52] U.S. Cl. ..... 338/302; 219/374; 219/375; 219/536; 338/294; 338/298; 338/299

[58] Field of Search ..... 338/294, 297, 298, 299, 338/302, 303, 319; 219/369, 370, 371, 372, 374, 375, 532, 536, 537

[56] References Cited

U.S. PATENT DOCUMENTS

| | | | |
|---|---|---|---|
| 2,985,795 | 5/1961 | Bird | 338/299 X |
| 2,997,569 | 8/1961 | Wagner | 219/371 X |
| 3,253,244 | 5/1966 | Hey et al. | 338/319 |
| 3,816,706 | 6/1974 | Maywald | 338/302 X |

FOREIGN PATENT DOCUMENTS

| | | | |
|---|---|---|---|
| 52462 | 12/1966 | German Democratic Rep. | 338/298 |

*Primary Examiner*—Volodymyr Y. Mayewsky
*Attorney, Agent, or Firm*—Peter Abolins; Clifford L. Sadler

[57] ABSTRACT

This specification discloses a cut-in resistance for motor vehicle heating fans with a first resistance wire winding which can be cut into an electric fan motor either alone or in series with a second resistance wire winding. The first winding is arranged in the interior of a ceramic tube and the second winding is arranged on the outside of the ceramic tube. The ceramic tube is retained solely by the ends of the resistance wires which are passed upwards to a ceramic plate and clamped by flat plug contacts. This produces a compact arrangement wherein the ceramic material can safely store generated heat without danger of heat damage to adjacent plastic components.

3 Claims, 4 Drawing Figures

CUT-IN RESISTANCE FOR MOTOR VEHICLE HEATING FANS

BACKGROUND OF THE INVENTION (1) Field of the Invention

This invention relates to a cut-in resistance for heating fans and, more particularly, a motor vehicle heating fan.

(2) Prior Art

In a known cut-in resistance for motor vehicle heating fans, the two windings made of resistance wire, which can be cut into the electric fan motor either alone or connected in series, are aligned lying one behind the other in the longitudinal direction on a plate made of insulating material. Their ends are clamped by bent parts of flat plug contacts penetrating the plate of insulating material. The two windings made of resistance wire are joined together by a soldered joint which is intended to melt and interrupt the current when the cut-in resistance overheats.

With this known construction of a cut-in resistance, many difficulties have arisen. When the cut-in resistance overheats due to a heavy-running electric fan motor or due to a cooling air supply interrupted by foreign bodies, although the safety solder joint becomes soft, it does not open due to deficient pretension at the two mutually connected ends of the windings. This results in a considerable overheating of the cut-in resistance over a long period whereby adjacent components made of plastics begin to melt or even in some cases to burn. These are some of the problems this invention overcomes.

SUMMARY OF THE INVENTION

In accordance with an embodiment of this invention, a cut-in resistance for motor vehicle heating fans is such that even when the cut-in resistance is overheated for long periods due to faults in the electric fan motor or in the cooling air circulation, any danger to adjacent components made of plastics or the like is reliably obviated.

According to the invention, this aim is achieved in that a cut-in resistance has a first winding made of resistance wire arranged in the interior of a ceramic tube and a second winding made of resistance wire arranged on the outer circumference of the ceramic tube, and the ceramic tube is retained solely by the ends of the resistance wires which are passed upwards to a ceramic plate and firmly clamped by flat plug contacts.

Advantageously, an embodiment of this invention has the second winding made of a smaller number of turns of thicker resistance wire which is operative for a second fan stage in combination with the first winding and is arranged on the external circumference of the ceramic tube. An embodiment of this invention can also include flat plug contacts which are riveted externally to the ceramic plate and secured against twisting by bent parts in bores of the ceramic plate and connected to the ends of the resistance wires by terminal lugs.

Because one of the windings made of resistance wire is arranged in the interior of a ceramic tube and the other of the windings made of resistance wire is arranged on the outer circumference of the ceramic tube and the ceramic tube is retained solely by the ends of the resistance wires which are passed upwards to a ceramic plate, and clamped by bent parts on flat plug contacts, an extremely compactly built arrangement of the necessary windings of resistance wires is achieved. Nevertheless, the ceramic material can safely store the resulting volume of heat if the cut-in resistance is overheated.

The critical winding made of resistance wire which is operative for the second fan stage is advantageously arranged on the outer circumference of the ceramic tube, where it is correspondingly well cooled.

Due to the fact that the ceramic tube is retained by the ends of the resistance wires, only easily fitted holes for the passage of the wires and for the fixing rivets of the flat plug contacts are necessary in the ceramic plate. Rotational securing of the flat plug contacts is achieved by bent parts on the contacts protruding into corresponding bores.

This invention will be explained more fully with reference to an examplary embodiment illustrated in the accompanying drawing, wherein:

DETAILED DESCRIPTION

Figure 1:
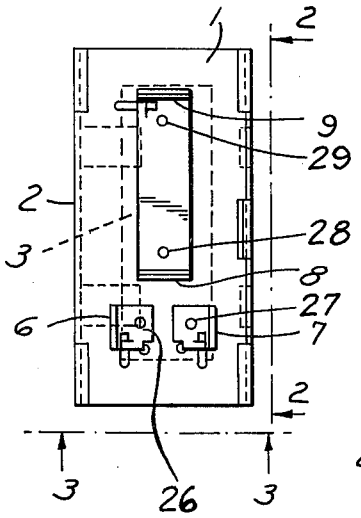
FIG. 1 shows an elevation of the cut-in resistance from the connection side of the ceramic plate.
Figure 2:
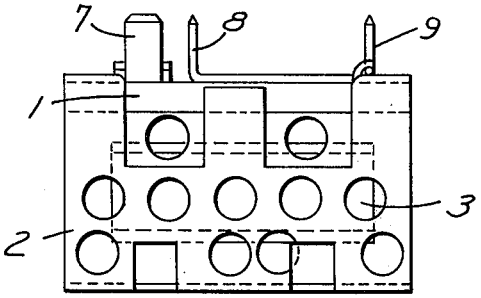
FIG. 2 shows an elevation of the cut-in resistance in the direction of the arrow II in FIG. 1.
Figure 3:
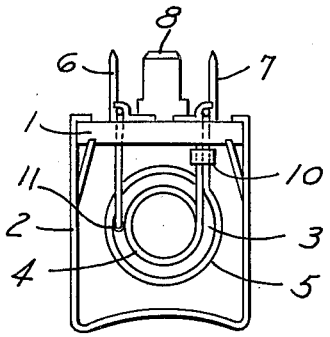
FIG. 3 shows an elevation of the cut-in resistance in the direction of the arrow III in FIG. 1.

The cut-in resistance shown in the figures substantially comprises a ceramic plate 1, a metal cage 2, a ceramic tube 3, windings 4 and 5 made of resistance wire and a number of flat plug contacts 6, 7, 8 and 9.

Metal cage 2 is fixed to ceramic plate 1 by appropriate tongues and protects resistance wire windings 4 and 5 from external contact. Inner winding 4 normally consists of a larger number of turns of a resistance wire of smaller diameter and is arranged in the interior of ceramic tube 3. Outer winding 5 normally consists of a smaller number of turns of a thicker resistance wire and is arranged on the external circumference of ceramic tube 3.

Outer winding 5 runs from flat plug contact 9 to flat plug contact 7 and is connected here by a terminal strip 10 to inner winding 4 which extends to the other end of ceramic tube 3 along its internal circumference and returns in a longitudinal bore 11 in the wall of ceramic tube 3 and is connected to the flat plug contact 6. Flat plug contacts 8 and 9 are mutually conductively connected.

If it is required to operate the electric fan motor in a first operational stage, voltage is applied to flat plug contacts 6 and 9, whereby the two windings 4 and 5 are connected in series and the heating fan accordingly runs at low speed. If it is required to switch to the second operative stage of the electric fan motor, voltage is applied to flat plug contacts 7 and 9, whereby only outer winding 5 is operative and the heating fan runs at high speed. If it is required to obtain the full speed of the heating fan, voltage is applied to the flat plug contacts 8 and 9, whereby said voltage is fed directly to the electric fan motor, the resistances being bypassed.

Figure 4:
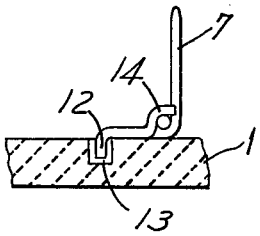
FIG. 4 shows a larger scale elevation of the rotational securing means of the flat plug contacts.

The fixing of flat plug contacts 6, 7, 8 and 9 is done in a conventional manner by riveting to ceramic plate 1. The flat plug contacts are preferably arranged externally on the ceramic plate 1 so that only holes for the passage of the ends of windings 4 and 5 and of the fixing rivets 26, 27, 28 and 29 need be provided in ceramic plate 1. In order to secure flat plug contacts 6 and 7, which do not pass through the ceramic plate 1, against rotation, contacts 6 and 7 are provided with bent parts 12 shown in FIG. 4, with which they project into bores 13 in ceramic plate 1. Flat plug contacts 6, 7 and 9 are further provided with terminal lugs 14 with which they directly anchor the ends of the resistance wires to the contacts.

The cut-in resistance explained exhibits the advantage that while having compact dimensions it permits a short-circuit-proof arrangement of the two windings made of resistance wire and simultaneously ensures high safety even during long overheating periods of resistance due to the thermal storage capacity present in the ceramic material.

Various modifications and variations will no doubt occur to those skilled in the various arts to which this invention pertains. For example, the flat plug contacts and the ceramic tube may vary in shape from that described. These and all other variations which basically rely on the teachings through which this disclosure has advanced the art are properly considered within the scope of this invention.

We claim:

1. A cut-in resistance for electrical heating fan motors, such as for motor vehicles, includes:

a first winding and a second winding each winding made of resistance wire and each having a pair of flat plug contacts, said first winding being adapted to be cut into an electric fan motor either alone or in series with said second winding a ceramic tube and an associated, spaced ceramic plate supporting said flat plug contacts;

said first winding being mounted on the interior surface of said ceramic tube and said second winding being mounted on the outer circumference surface of said ceramic tube, being coupled thereto by a circumferential winding;

a perforated, U-shape metal cage means closed by said ceramic plate, said metal case means securing said ceramic plate and circumferentially, spacially surrounding said ceramic tube and said windings thereby shielding said first and second windings; and said ceramic tube being retained solely by the ends of the resistance wires which are passed toward said ceramic plate and firmly clamped by said flat plug contacts.

2. A cut-in resistance as recited in claim 1 wherein said second winding has a smaller number of turns of thicker resistance wire and is arranged on the external circumference of said ceramic tube.

3. A cut-in resistance as recited in claims 1 or 2, further comprising bores in said ceramic plate, and bent parts and terminal lugs associated with said flat plug contacts, said flat plug contacts being riveted externally to said ceramic plate and secured against twisting by said bent parts in said bores of said ceramic plate and connected to the ends of the resistance wires by said terminal lugs.

* * * * *